United States Patent [19]

Alameddine

[11] Patent Number: 4,986,352

[45] Date of Patent: Jan. 22, 1991

[54] INTERMITTENT STEAM INJECTION

[75] Inventor: Bassem R. Alameddine, Carrollton, Tex.

[73] Assignee: Mobil Oil Corporation, Fairfax, Va.

[21] Appl. No.: 413,641

[22] Filed: Sep. 28, 1989

[51] Int. Cl.[5] ..... E21B 43/24; E21B 43/30

[52] U.S. Cl. ..... 166/263; 166/245; 166/272

[58] Field of Search ..... 166/245, 263, 272, 303

[56] References Cited

U.S. PATENT DOCUMENTS

| | | | |
|---|---|---|---|
| 3,332,482 | 7/1967 | Trantham | 166/263 X |
| 3,771,598 | 11/1973 | McBean | 166/268 |
| 3,796,262 | 3/1974 | Allen et al. | 166/263 X |
| 4,130,163 | 12/1978 | Bombardieri | 166/263 X |
| 4,182,416 | 1/1980 | Trantham et al. | 166/263 X |
| 4,257,650 | 3/1981 | Allen | 166/263 X |
| 4,262,745 | 4/1981 | Stewart | 166/263 |
| 4,271,905 | 6/1983 | Redford et al. | 166/263 |
| 4,445,573 | 5/1984 | McCaleb | 166/303 X |
| 4,612,989 | 9/1986 | Rakach et al. | 166/263 |
| 4,635,720 | 1/1987 | Chew | 166/263 X |

FOREIGN PATENT DOCUMENTS

| | | | |
|---|---|---|---|
| 733808 | 5/1966 | Canada | 166/272 |

*Primary Examiner*—George A. Suchfield
*Attorney, Agent, or Firm*—Alexander J. McKillop; Charles J. Speciale; Charles A. Malone

[57] ABSTRACT

A method for intermittent steam injection which comprises completing wells in more than one zone and selecting a number of wells as steam injectors. As interwell communication (temperature breakthrough) develops, producers are shut-in to allow for the reservoir pressure to build up and heat to propagate from the channel of communication (e.g., fractures) to the reservoir matrix. The injection phase is followed by blowdown. Thereafter, shut in producers and, in certain other cases, injectors are put on production.

8 Claims, 6 Drawing Sheets

INTERMITTENT STEAM INJECTION

FIELD OF THE INVENTION

This invention relates to a method for recovering oil from a subterranean, viscous oil-containing formation containing multiple overlying oil-bearing sand permeable layers separated by impermeable none oil-bearing layers. The method employs intermittent steam injection into the separated sand layers.

BACKGROUND OF THE INVENTION

Steam has been used in many different methods for the recovery of oil from subterranean, viscous oil-containing formations. The two most basic processes using steam for the recovery of oil includes a "steam drive" process and "huff and puff" steam processes. Steam drive involves injecting steam through an injection well into a formation. Upon entering the formation, heat transferred to the formation by the steam lowers the viscosity of the formation oil, thereby improving its mobility. In addition, continued injection of steam provides a drive to displace the oil toward a production well from which it is produced. "Huff and puff" processes involves injecting steam into a formation through a well, stopping the injection of steam, permitting the formation to soak and then back producing oil through the original well.

Steamflooding a multi-sand reservoir suffers from poor vertical sweep efficiency caused by unequal steam distribution in the injection wellbore. While establishment of thermal communication between injector and producer is a necessary step for a successful steamflood, such a communication usually develops in a limited number of sands containing oil. With continuing steam injection, the sands in thermal communication tend to receive a majority of the steam, which leads to an increase in its steam/gas saturation. As a result, pressure drop between injector and producer wells become very small. This pressure drop occurs because steamed-out sand acts as a thief zone. With such a small pressure differential, little or no steam is directed to the other target sand layers.

MacBean in U.S. Pat. No. 3,771,598 which issued on Nov. 13, 1973 teaches a method for producing hydrocarbons from a subterranean formation penetrated by an injection well and at least one production well. In this method a mobilizing fluid such as steam was injected through said injection well and into the formation. Steam injection was continued at a pressure level and for a time sufficient to cause breakthrough of the mobilizing fluid through said formation to at leas one production well. Afterwards, the pressure was increased in the productive interval of a formation adjacent said production well after breakthrough had occurred by injecting another fluid down the production well while continuing injection of mobilizing fluid into said formation. Thereafter, hydrocarbons were produced from the formation while maintaining the increased pressure in the formation.

Bombardieri in U.S. Pat. No. 4,130,163 which issued on Dec. 19, 1978 teaches a process for recovering hydrocarbons from a subterranean hydrocarbon-bearing formation which is penetrated by at least two wells having a communicating relationship. A heated fluid is injected into the formation at relatively high pressures by means of both wells for a relatively short period of time, sufficient to fluidize hydrocarbons therein and produce hydrocarbons upon cessation of said injection, but insufficient to result in fluid breakthrough. Next one well is shut in and hydrocarbons are recovered from the formation via the other well. A minimum production rate is selected for the other well whereby a relatively long production span is established. The production rate of the hydrocarbon from the other well is monitored. Afterwards, the production rate declines to the minimum rate, along with reduced temperatures of the produced fluids and additional heated fluid is injected into one well at relatively low pressures over a relatively long time. The objective was to create a driving force into the formation by means of one well and continue production of hydrocarbons from the other well while continuing said fluid drive but without breakthrough. None of the prior art methods solved the problem of removing hydrocarbons during the steam flood from a multiple-sand reservoir which suffers from poor vertical sweep efficiency caused by unequal steam distribution in the injection well.

Therefore, what is needed is a method for equal steam distribution in an injection well to remove hydrocarbonaceous fluid from a multi-sand reservoir which will improve vertical sweep efficiency.

SUMMARY

This invention is directed to a method for improving the vertical sweep efficiency of a reservoir or formation having multiple oil-containing layers of sand where intermittent steam injection is utilized. In carrying out this method, a substantially large pore volume of steam is injected into each layer by at least two spaced apart wells which causes the reservoir to be pressurized thereby propagating heat away from any induced fracture in said reservoir or formation. Afterwards, the reservoir pressure is increased as steam injection continues until steam has partially entered each layer. The wells are then shut in and heat is allowed to build up in each of said layers so as to reduce the viscosity of oil contained in each layer. Once the wells have been shut in for a period of 30 days or less, the wells are opened and hydrocarbonaceous fluids along with water are produced to the surface. Afterwards, the steps are repeated while the volume of steam is increased after each subsequent cycle of steps.

It is therefore an object of this invention to obtain favorable steam injection distribution by intermittent steam injection into a multi-sand layer reservoir.

It is another object of this invention to enhance equal steam injection distribution by increased reservoir pressurization.

It is still yet a further object of this invention to decrease the steam/oil ratio by cyclic steam injection when at least two oil containing sand layers are produced together.

It is yet an even further object of this invention to increase steamed injection volume with each cycle so as to maintain cyclic production and efficiency by intermittent steam injections.

It is an even still yet further object of this invention to correct poor vertical sweep efficiency during steam injection of a multi-layer sand reservoir by eliminating the small pressure differential that develops between injector and producer wells.

DESCRIPTION OF PREFERRED EMBODIMENTS

Figure 1A:
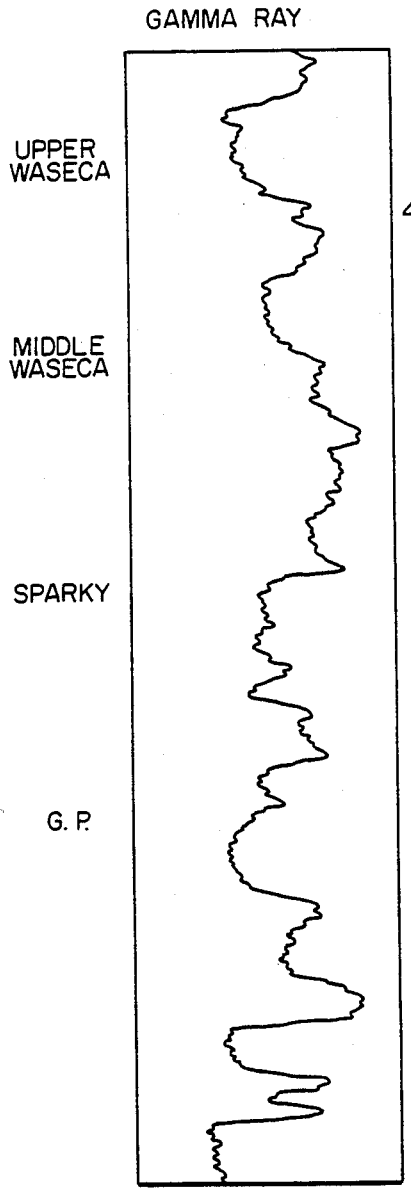
FIGS. 1A and 1B are charts which shows the gamma ray or the stratification of permeable/non-permeable zones in a formation.
Figure 1B:
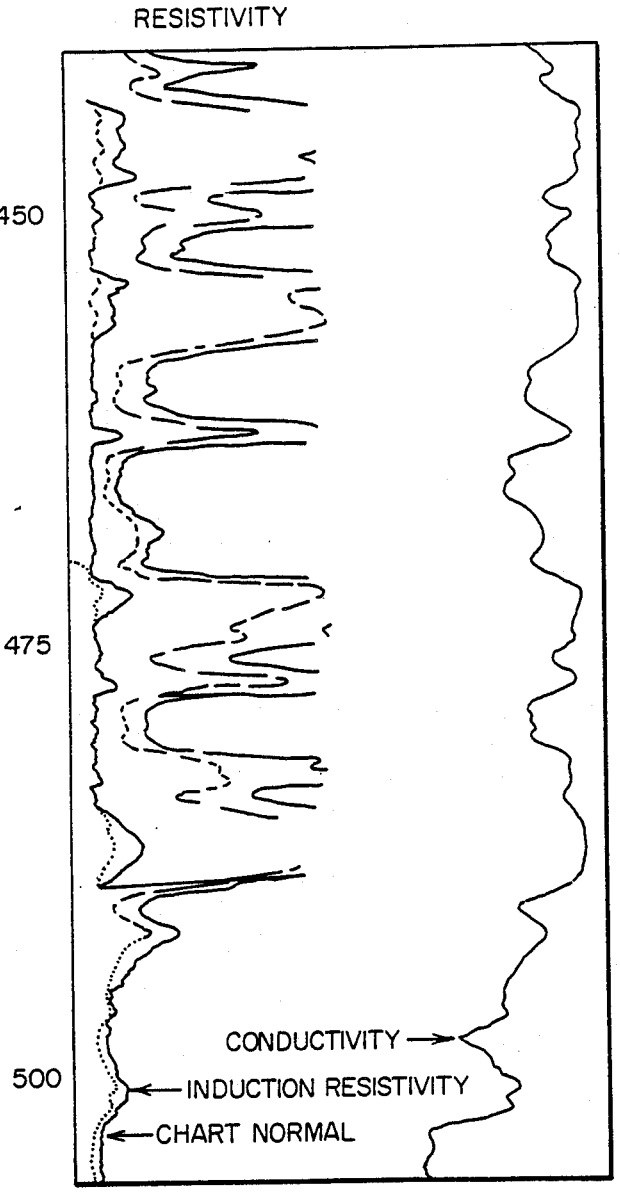
Figure 2:
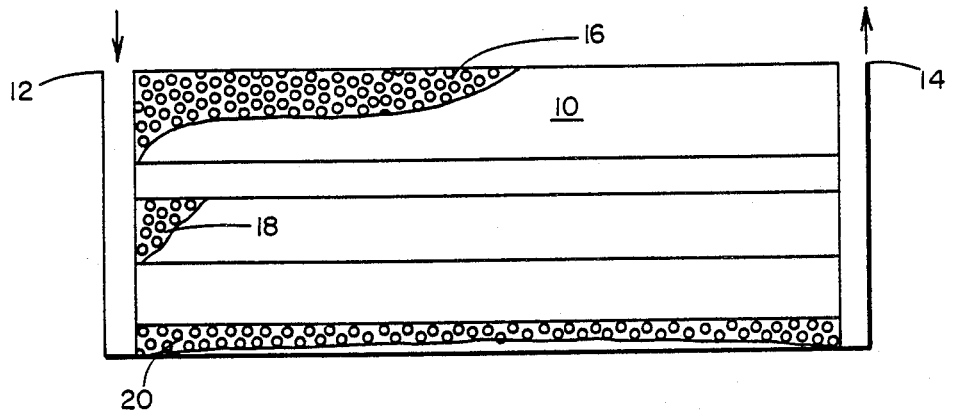
FIG. 2 is a schematic representation which depicts how a steam flood is conducted in a formation.
Figure 2A:
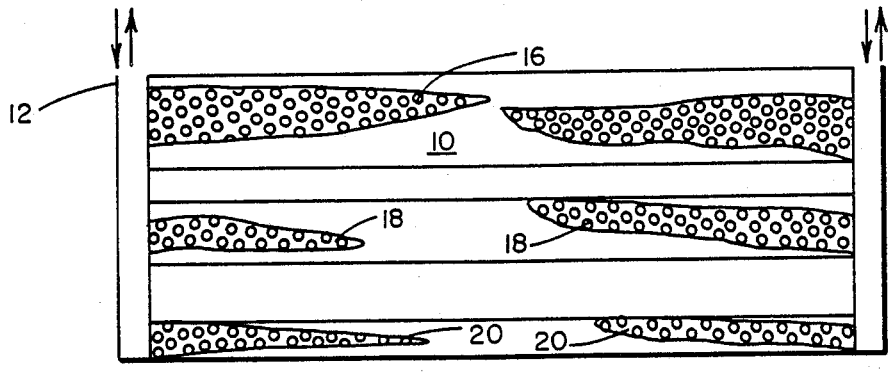
FIG. 2A is a schematic representation of the formation wherein cyclic/intermittent steam injection is conducted in a formation.

As presently employed in the art, as is shown in FIG. 2, steam is injected into injection well 12 where it enters formation 10 and breaks through one of the more permeable sand levels of displacement into production well 14 so as to remove hydrocarbonaceous fluids from the reservoir. The present invention is directed to a cyclic-/intermittent steam injection system as is represented in FIG. 2A.

In the practice of this invention, a substantially large pore volume of steam (generally over 10% of the pore volume) is injected during each cycle into injection well 12. Afterwards, the production well 14 is shut in. Steam enters one of the more permeable sand layers i.e., 16, 18 or 20 and proceeds into production well 14. Because production well 14 is shut in, steam is forced to enter an unpenetrated sand layer of formation 10. Formation 10 is allowed to pressurize so as to propagate heat away from any induced fractures in formation 10. Since the production well or wells are kept shut-in, the injection and reservoir pressure are expected to increase with time.

While some of the steam that is initially injected is going to go into one sand layer i.e., 16, 18 or 20, others will be receiving little or no steam. However, as the pressure is allowed to build up, the steam which is injected doesn't find an outlet because the production well or wells are shut-in. Injection steam will be directed into another sand-layer so as to cause the pressure in the formation to equalize. As reservoir pressure increases in one sand layer, its pressure drop (differential between injection pressure and reservoir pressure) tends to get smaller, while that for the other sands gets larger. A certain point is reached when the steam will enter the other sands so as to equalize the pressure build-up. The magnitude of reservior pressure increase is dependent upon the compressibility of the system and the percentage of pore volume injected. This relationship is shown by the formula $$dP = \frac{1}{c} \times \left( \frac{dv}{v} \right)$$

This relationship was verified by a test which was run on an oil producing formation. For this test, average reservoir pressure during a seven cycle of injection caused the reservoir pressure to increase 800 psi after injecting 12% cold water equivalent (CWE) of the pore volume.

Figure 3:
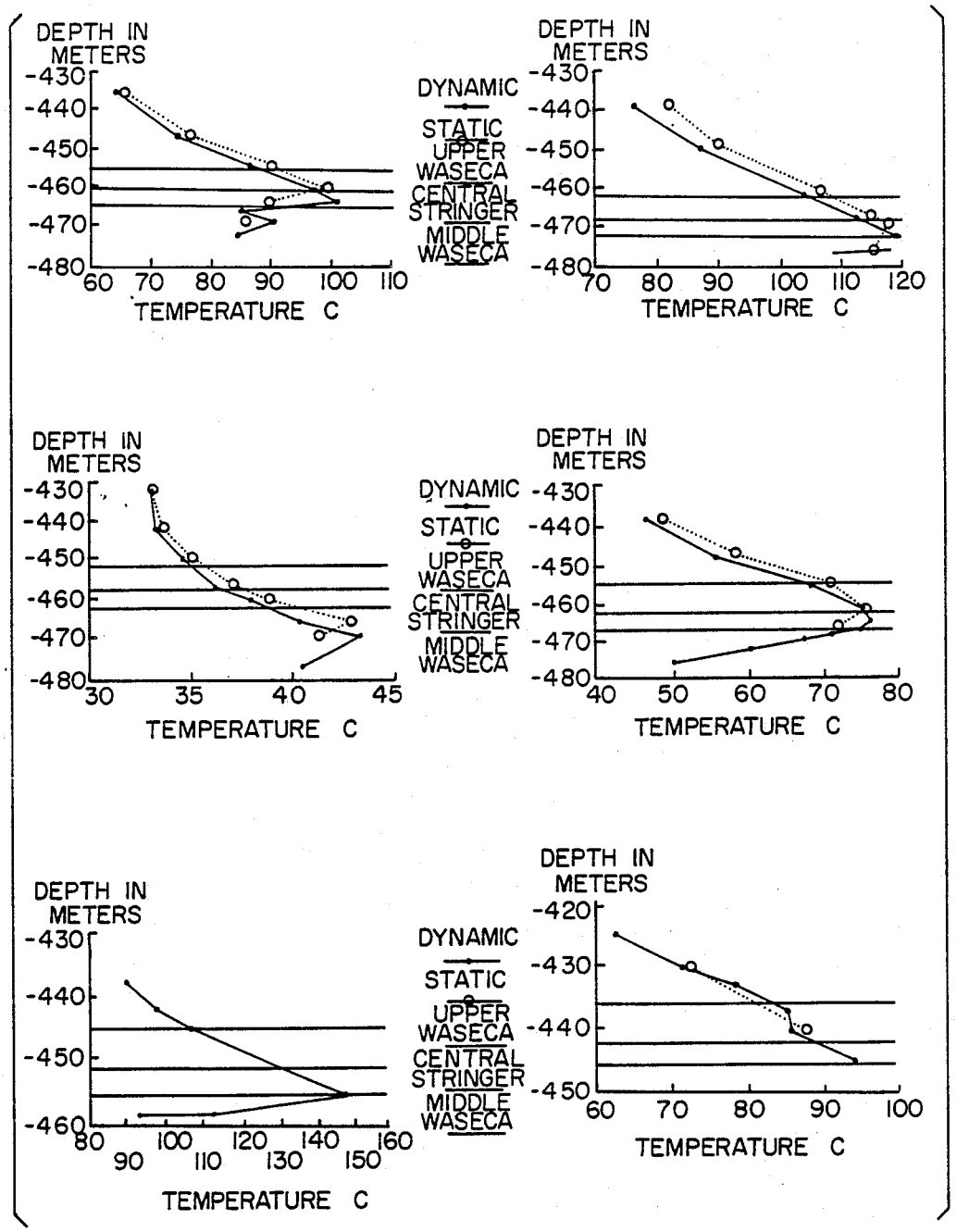
FIG. 3 is a graph showing a temperature profile of a formation.

Utilizing this steam injection method allows heat loss to be recaptured. The thinner the sands in question and the smaller the separation between them, the higher the amount of heat loss by conduction. This is illustrated in FIG. 3 which shows the result of steam injection into the middle of a formation where such steam injection has resulted in a temperature increase in the sand layers above the layer where the steam entered. As shown in the graph, the average rate of heat conduction is about 1.3° F. per foot. This increase in reservoir temperature is expected to yield an increase in primary productivity due to decreased oil viscosity. Heat loss is therefore recaptured when the upper sand layer is comingled with a low one during the injection and production phases of an intermittent steam injection operation. Once the steam has been confined within formation 10 for a desired period of time, hydrocarbonations fluids are produced from the injector well and the production well.

Figure 4:
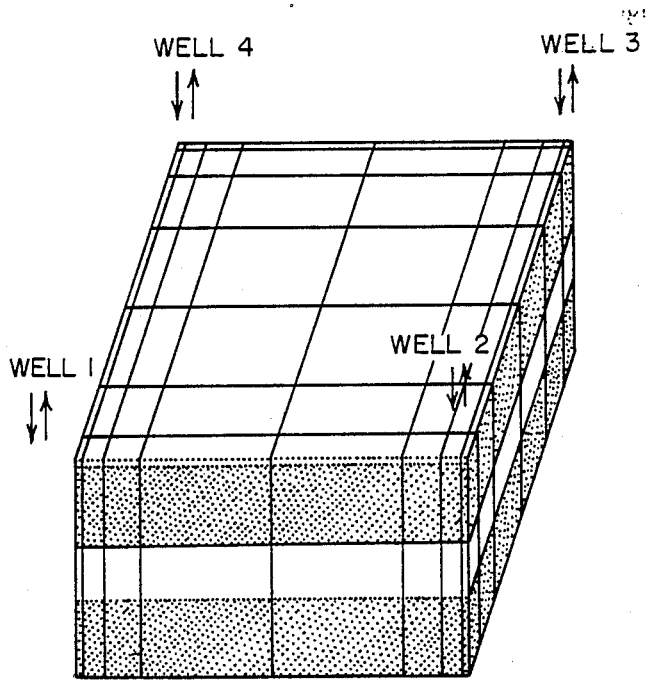
FIG. 4 is a three-dimensional (3-D) multi-layered model which shows a simulated operation of a cyclic-/intermittent steam injection process.

The results of the pilot study were confirmed by a three-dimensional numerical simulation model which simulated reservoir conditions. The laboratory model consisted of 8"×8"×3" grid blocks which were used to simulate two sand layers in a reservoir separated by a non-productive layer. The only heat utilized was the heat of conduction. As shown in FIG. 4, the bottom sand is simulated to be 16' thick and separated from a simulated top 12' sand layer by a simulated 12' impermeable layer. Four wells were located in each corner and were simulated to be about 460 ft. apart. The vertical fracture is represented by a small grid block between wells. Reservoir properties of both sands as is shown in Table 1 were assumed to be the same, while relative permeability and oil saturation were similar to the reservoir which was a subject of the pilot study. These values are expressed in Table 1. Steam injection rate and duration, as well as timing of the production cycle were kept constant in all the cases which were utilized as will be discussed below, unless otherwise specified. The three-dimensional simplified model used herein is intended to show the effects of comingling of intermittent steam injection. It is not used to predict the exact distribution of steam injection. Table 1 used for the reservoir properties in the case studies in conjunction with the three-dimensional model appear below.

TABLE 1

| AVERAGE INITIAL RESERVOIR PROPERTIES | |
|---|---|
| Pressure | 300 psi |
| Temperature | 61° F. |
| Oil Saturation | 70% |
| Water Saturation | 25% |
| Porosity | 35% |
| Permeability | 1 Darcy |
| Permeability of non-productive zone | 0 Darcy |
| Pump-off Pressure | 40 psi |
| Steam Quality | 60% |

Four cases were analyzed. Performance of the four cases was observed over eight cycles of steam injection. Sensitivity studies included effects of increased steam injection volume and timing of comingling.

Case 1 consisted of injecting steam into the bottom sand only and a selected number of wells, while other offset wells were kept shut-in these wells were put on production for a period of about 200 to about 300 days before starting the next injection phase. A total of eight cycles were performed with a sequence of wells selected for steaming as is shown in Table 2 below.

TABLE 2

| SEQUENCE OF STEAM INJECTION |
|---|
| Cases 1, 2, and 3 |
| Cycle 1 inject 3,400 bbl (1.8% PV*) in well 2 |
| Cycle 2 inject 3,400 bbl (1.8% PV) in well 4 |
| Cycle 3 inject 6,800 bbl (3.6% PV) in wells 1 and 3 |
| Cylce 4 inject 10,880 bbl (5.8% PV) in wells 2 and 4 |
| Cycle 5 inject 13,600 bbl (7.2% PV) in wells 1 and 3 |
| Cycle 6 inject 16,320 bbl (8.7% PV) in wells 2 and 4 |
| Cycle 7 inject 21,760 bbl (11.6% PV) in wells 1, 2, 3, and 4 |
| Cycle 8 inject 21,760 bbl (11.6% PV) in wells 1, 2, 3, and 4 |
| Case 1a |
| Cylce 1 to 4 - same as before |
| Cycle 5 inject 10,880 bbl (5.8% PV) in wells 1 and 3 |
| Cycle 6 inject 10,880 bbl (5.8% PV) in wells 2 and 4 |
| Cycle 7 inject 10,880 bbl (5.8% PV) in wells 1 and 3 |
| Cycle 8 inject 10,880 bbl (5.8% PV) in wells 2 and 4 |

*PV = pore volume

As is shown in Table 2, the volume of injected steam was increased from cycle to cycle. The volume was increased because the number of wells cyclically steamed were increased and also because a deeper contact of the reservoir matrix by steam was needed to maintain/improve oil recovery from cycle to cycle.

Case 1a is similar to case 1, with the exception that steam injection volume per well is kept constant after the fifth cycle.

Case No. 2 included comingling of upper and lower sand layers after four cycles of steam injection in the lower sand only. No changes in Case 1 steam injection volume were made.

Case 3 included steam injection in both upper and lower sands beginning with the first cycle. Steam injection volume was similar that utilized in Case 1.

Figure 5A:
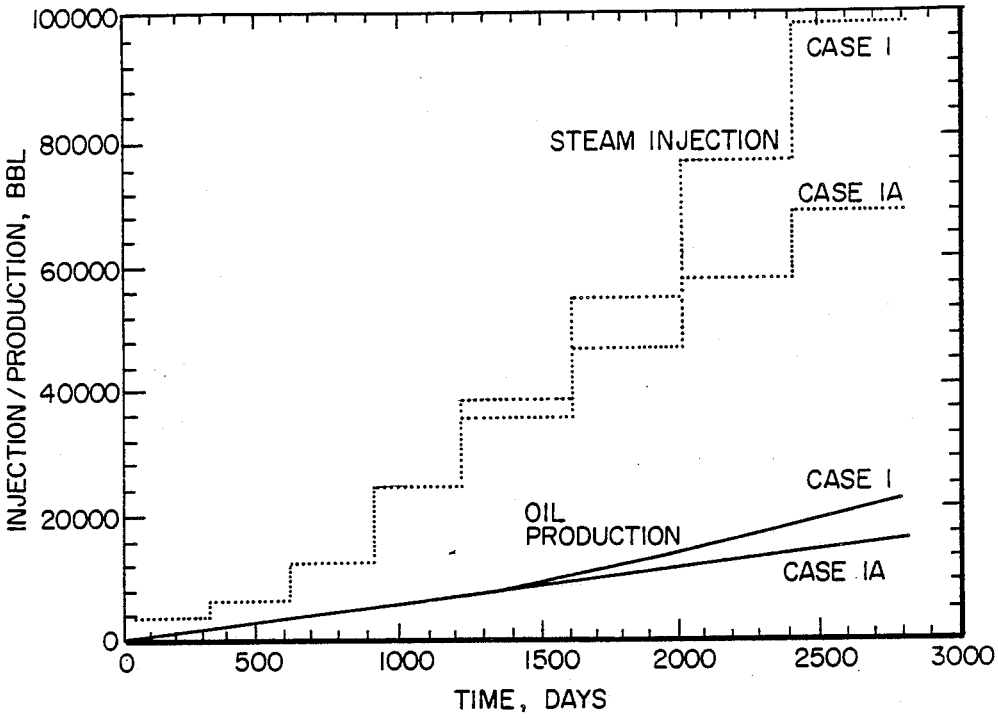
FIGS. 5A and 5B are graphical representations which shows the effects of increased steam injection volume on the recovery of an intermittent steamflood.
Figure 5B:
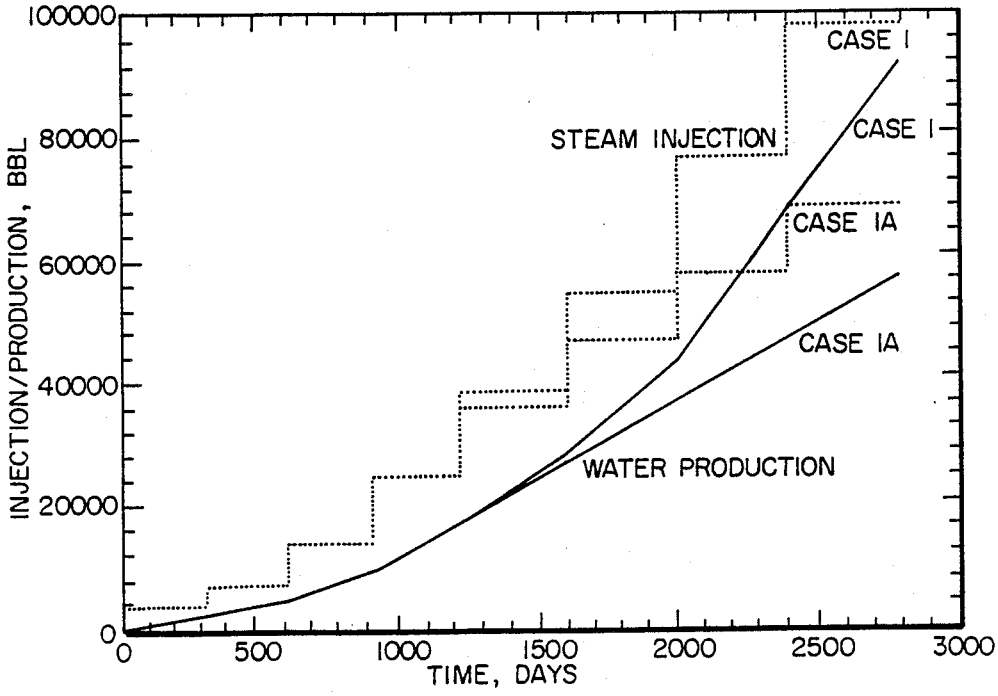

As shown in FIG. 5, increased steam injection volume, from cycle to cycle, improves oil production with only a slight improvement in steam efficiency. This is caused by a deeper steam contact with the reservoir matrix and increased reservoir pressurization. A comparison of case 1 to case 1a indicates that keeping the steam injection volume constant from cycle to cycle results in a deterioration in the volume of oil produced. Such an observation correlates well with the results obtained from a pilot run where steam injection volume was increased from cycle to cycle with a small variation in steam/oil ratio.

Figure 6:
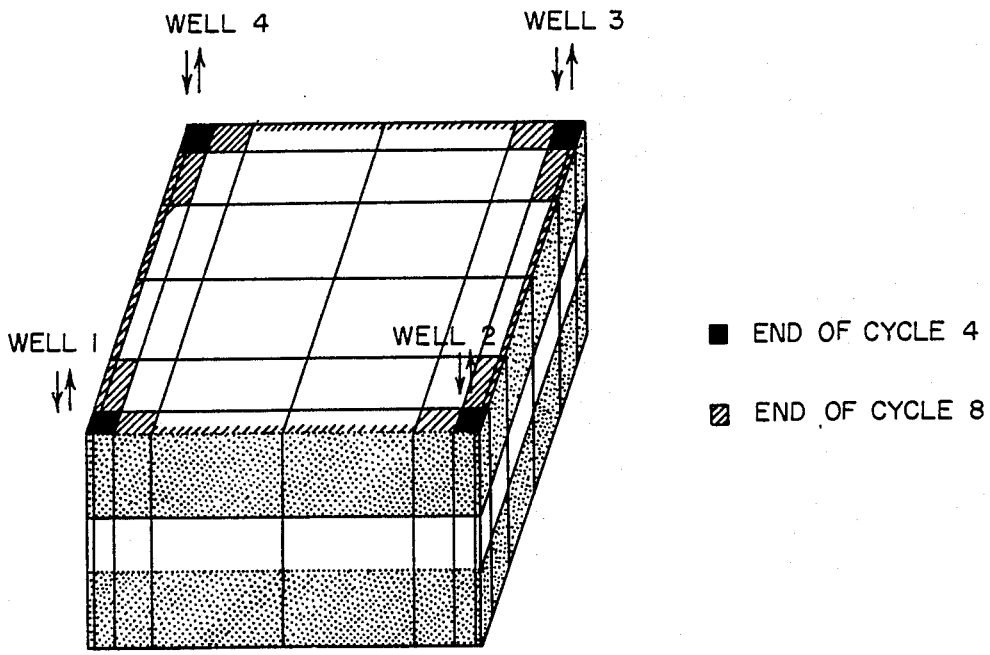
FIG. 6 is a three-dimensional (3-D) multi-layered model which shows a simulated operation of a cyclic-/intermittent steam injection process at the end of four and eight cycles.

As demonstrated in the simulations, heat is conducted from the lower to the upper sand layer. This is shown by the increase in average temperature of the grid blocks in the upper sand. A plot of such temperature increase is shown in FIG. 6. As depicted in FIG. 6, a continuous increase in reservoir temperature of the upper sand layer occurs from cycle 1 to cycle 8. This increase in temperature is dependent on: (1) volume of steam injected, (2) length of injection/production phase, (3) injection pressure and steam temperature, (4) vertical separation among individual sands, as well as thickness of upper sand, and (5) the presence of conduction and/or convection. For these reasons, it is necessary to determine how much heat will be lost from one sand to another before counting on benefits of a multi-sand completion.

Figure 7A:
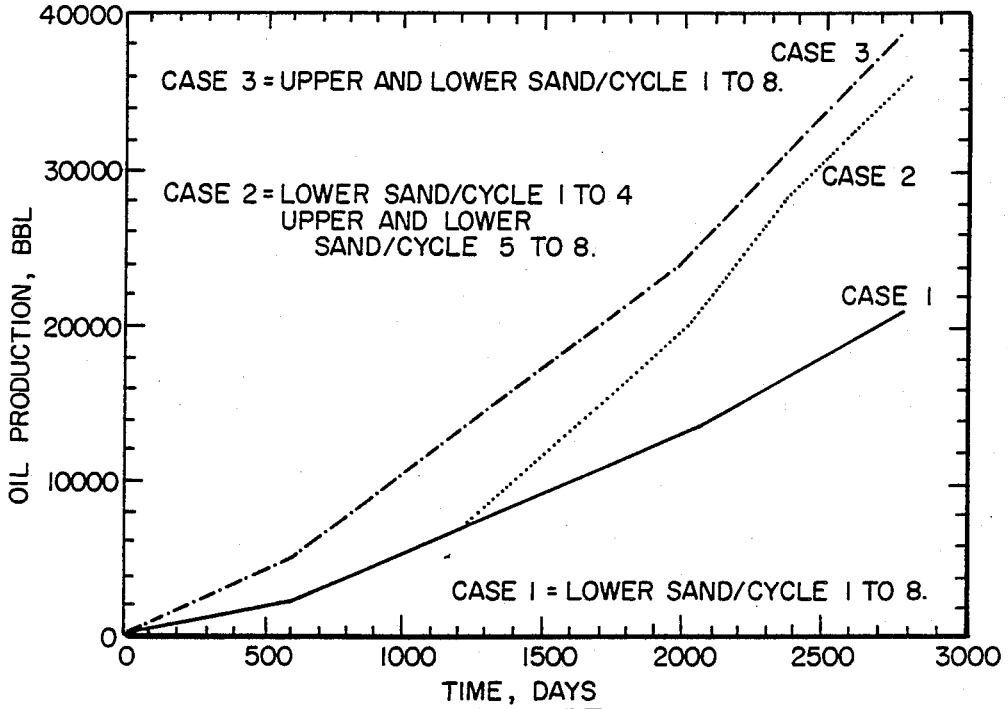
FIG. 7A and 7B are graphical representations which shows the effects of co-mingling steam injection into multi-sand levels simultaneously.
Figure 7B:
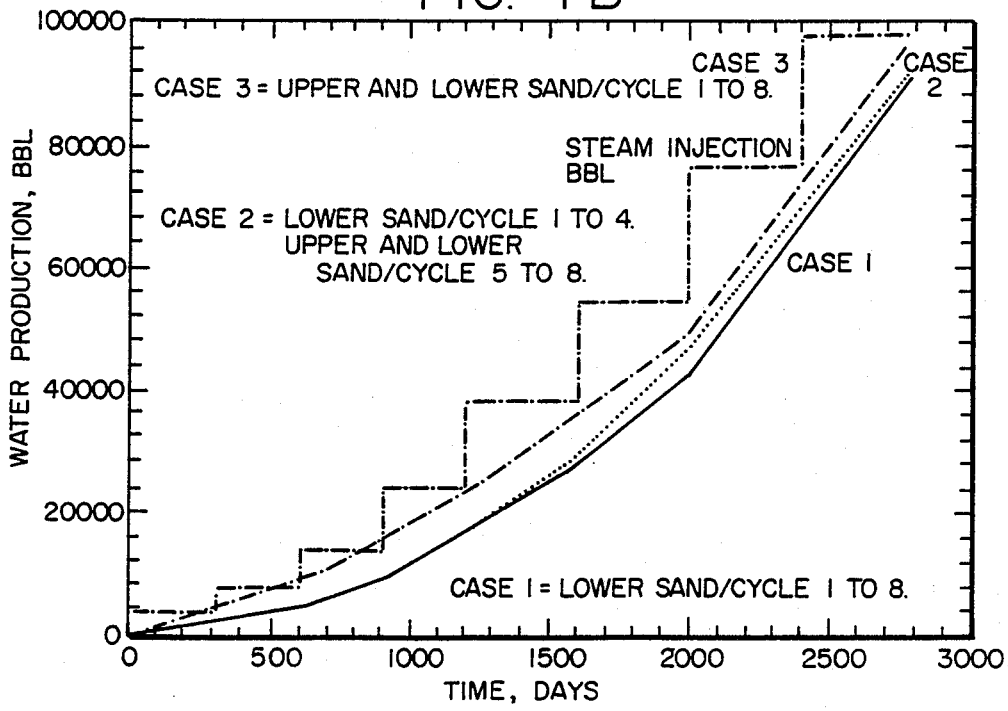

Earlier comingling of two zones where heat is conducted from the lower to the upper sand layer is demonstrated to be more beneficial than a single zone completion as is depicted in FIG. 7. A comparison of cases 1, 2 and 3 indicates a major benefit obtained from injecting in both sands at the same time. Steam/oil ratio is improved from 4.6 to 2.7 and 2.5 in cases 2 and 3. Watercut decreased from 81 to about 71% as shown in Table 3 which follows:

TABLE 3

| PERFORMANCE PREDICTION OF 8 CYCLES | |
|---|---|
| Case 1 | Cumulative steam/oil ratio - 4.6 |
| | Cumulative water cut - 81% |
| Case 1a | Cumulative steam/oil ratio - 4.7 |
| | Cumulative water cut - 80% |
| Case 2 | Cumulative steam/oil ratio - 2.7 |
| | Cumulative water cut - 72% |
| Case 3 | Cumulative steam/oil ratio - 2.5 |
| | Cumulative water cut - 71% |

Improvement in case 2 due to three factors. These factors are: (1) heat lost to the upper sand layer was recaptured and utilized; (2) good distribution of steam injection between the two sand layers; and (3) primary production contribution from two sand layers compared to one. Steam distribution is expected to change from cycle to cycle, as observed in the pilot study where a single well cyclic steam operation was utilized. Because of this distribution change, it is very difficult to quantify. Most importantly, steam can enter both zones. Additional assumptions made that could affect the results of this numerical simulation include fractures in the upper sand layer which are assumed to propagate in the same direction as the one in the lower sand layer. This assumption is caused by the gridding limitations of the model. As will be understood by those skilled in the art, the magnitude of the results obtained from this study will vary with model assumptions.

Obviously, many other variations and modifications of this invention as previously set forth may be made without departing from the spirit and scope of this invention as those skilled in the art readily understand. Such variations and modifications are considered part of this invention and within the purview and scope of the appended claims.

I claim:

1. A method to improve vertical sweep efficiency during intermittent steam injection into a multi-layered oil containing reservoir comprising:

a. injecting a substantially large volume of steam into said reservoir via at least one injector well into a lower level of said reservoir while at least one producer well is shut in which pressurizes the reservoir and propagates heat away from any induced fracture;

b. allowing the reservoir pressure to increase as steam injection continues until steam has entered each layer of the reservoir;

c. shutting in the injector well and allowing each layer of the reservoir to heat up so as to reduce the viscosity of oil contained in each layer; and d. opening the producer well and producing oil to the surface thereby completing one cycle.

2. The method as recited in claim 1 where after step (d), steps (a) through (d) are repeated for eight cycles.

3. The method as recited in claim 1 where the volume of steam injected is increased during each subsequent cycle which results in deeper contact of the reservoir matrix by steam.

4. The method as recited in claim 1 were oil is produced from the formation for about 200 to 300 days before commencing another injection cycle.

5. The method as recited in claim 1 where initially steam comprising over 10% of the reservoir's pore volume is injected into the reservoir.

6. The method as recited in claim 1 where the injector well in step (d) is shut in for a desired time and thereafter oil is produced from both the injector and producer wells.

7. The method as recited in claim 1 where at least two injector and two producer wells are utilized.

8. The method as recited in claim 1 where after step (d), steps (a) through (d) are repeated for three cycles where the volume of steam injected is increased during each subsequent cycle and thereafter, steps (a) through (d) are repeated for four cycles during which the volume of steam injected is kept constant.

* * * * *